US009786987B2

(12) United States Patent
Matsuoka et al.

(10) Patent No.: US 9,786,987 B2
(45) Date of Patent: Oct. 10, 2017

(54) SMALL ANTENNA APPARATUS OPERABLE IN MULTIPLE FREQUENCY BANDS

(71) Applicant: Panasonic Corporation, Kadoma-shi, Osaka (JP)

(72) Inventors: Yasuharu Matsuoka, Osaka (JP); Kazuya Nakano, Osaka (JP); Kouji Watanabe, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 142 days.

(21) Appl. No.: 13/783,748

(22) Filed: Mar. 4, 2013

(65) Prior Publication Data

US 2014/0078001 A1 Mar. 20, 2014

(30) Foreign Application Priority Data

Sep. 14, 2012 (JP) ..... 2012-203066

(51) Int. Cl.

| | |
|---|---|
| ***H01Q 5/321*** | (2015.01) |
| ***H01Q 5/00*** | (2015.01) |
| ***H01Q 1/22*** | (2006.01) |
| ***H01Q 9/42*** | (2006.01) |
| ***H01Q 5/385*** | (2015.01) |

(52) U.S. Cl.

CPC ..... *H01Q 5/0024* (2013.01); *H01Q 1/2266* (2013.01); *H01Q 5/321* (2015.01); *H01Q 5/385* (2015.01); *H01Q 9/42* (2013.01)

(58) Field of Classification Search

CPC ..... H01Q 5/321; H01Q 5/385; H01Q 5/0024; H01Q 9/42; H01Q 1/2266

See application file for complete search history.

(56) References Cited

U.S. PATENT DOCUMENTS

| | | | | |
|---|---|---|---|---|
| 6,839,040 | B2 * | 1/2005 | Huber | H01Q 1/243 343/700 MS |
| 7,057,565 | B1 * | 6/2006 | Liu | 343/700 MS |
| 2009/0322618 | A1 | 12/2009 | Shoji | |
| 2012/0092220 | A1 | 4/2012 | Tani et al. | |
| 2013/0273944 | A1 * | 10/2013 | Wilson et al. | 455/457 |

FOREIGN PATENT DOCUMENTS

| | | |
|---|---|---|
| JP | 2010-10960 | 1/2010 |
| JP | 2012-85215 | 4/2012 |

* cited by examiner

*Primary Examiner* — Graham Smith
*Assistant Examiner* — Noel Maldonado
(74) *Attorney, Agent, or Firm* — Hamre, Schumann, Mueller & Larson, P.C.

(57) ABSTRACT

An antenna apparatus is provided with a dielectric substrate, a feed point, a first radiation conductor, a second radiation conductor, and a through-hole conductor. The first radiation element is capacitively coupled to the second radiation element in a portion where the first and second radiation conductors overlaps with each other via the dielectric substrate. At least one of the first and second radiation elements has a meander portion formed in the portion where the first and second radiation elements are capacitively coupled to each other, and an LC resonator is formed of the meander portion, and the portion where the first and second radiation elements are capacitively coupled to each other.

10 Claims, 19 Drawing Sheets

10

10

10

11

12

SMALL ANTENNA APPARATUS OPERABLE IN MULTIPLE FREQUENCY BANDS

BACKGROUND

1. Technical Field

The present disclosure relates to an antenna apparatus, and more particularly, relates to a small antenna apparatus operable in multiple bands. The present disclosure also relates to a communication apparatus and an electronic device, provided with such an antenna apparatus.

2. Description of Related Art

A multiband antenna of Japanese Patent Laid-open Publication No. 2010-010960 is provided with: at least two antenna elements for a low frequency band and for a high frequency band; a feed point portion shared between the two antenna elements for the low frequency band and for the high frequency band; and an impedance matching unit inserted and connected between a feed point end and an open end of the antenna element for the high frequency band. The impedance matching unit is composed of an LC parallel resonant circuit operable as an inductor in the low frequency band, and operable as a capacitor in the high frequency band.

A multiband antenna of Japanese Patent Laid-open Publication No. 2012-085215 is provided with: a substrate; a ground element formed on any surface of the substrate and having a ground voltage; a first antenna element formed on any surface of the substrate; a feed portion for feeding the first antenna element; a second antenna element formed on an opposite surface of the substrate to the surface on which the first antenna element is formed; a first ground wire extending from the ground element; a first interlayer connecting portion formed to penetrate through the substrate, and electrically connecting the first and second antenna elements; a first capacitive coupling portion where the first and second antenna elements are overlapped or close to each other via the substrate, thus capacitively coupling to each other; and a loop structure electrically configured by the first antenna element, the second antenna element, the first interlayer connecting portion, and the first capacitive coupling portion. Each of the first antenna element, the second antenna element, the ground element, and the first ground wire is formed by a conductive pattern on any surface of the substrate.

SUMMARY

In the case that an antenna apparatus is provided within a housing of a wireless communication apparatus, the antenna apparatus may be electromagnetically coupled to metal parts and/or the housing of the wireless communication apparatus, thus degrading radiation efficiency. Further, in the case that size of such a wireless communication apparatus should be reduced, the distance between the antenna apparatus and the metal parts and/or the housing is reduced, thus further degrading radiation efficiency. Hence, a small antenna apparatus is required in order to reduce the electromagnetic coupling between the antenna apparatus and the metal parts and/or the housing.

The present disclosure provides a small antenna apparatus operable in multiple bands. The present disclosure also provides a communication apparatus and an electronic device, provided with such an antenna apparatus.

An antenna apparatus according to the present disclosure is provided with: a dielectric substrate, a feed point, a first radiation element, a second radiation element, and at least one through-hole conductor. The dielectric substrate has a first end and a second end along a longitudinal direction, and has a first surface and a second surface. The feed point is provided at a position of the dielectric substrate. The first radiation element is formed on the first surface, and extending over a first length from the feed point toward the second end of the dielectric substrate, and the first radiation element has a first end close to the feed point and a second end remote from the feed point. The second radiation element is formed on the second surface, and extends over a second length along the longitudinal direction of the dielectric substrate. The second radiation element has a first end and a second end, and the second end is remoter from the feed point than the first end. The second radiation element includes a portion overlapping with the first radiation element via the dielectric substrate, and a portion extending from a position overlapping with the second end of the first radiation element towards the second end of the dielectric substrate. The at least one through-hole conductor is provided at a position in the portion where the first and second radiation conductors overlaps with each other via the dielectric substrate, and the through-hole conductor penetrates through the dielectric substrate, and electrically connects the first and second radiation elements. The first radiation element is capacitively coupled to the second radiation element in the portion where the first and second radiation conductors overlaps with each other via the dielectric substrate. At least one of the first and second radiation elements has a meander portion formed in the portion where the first and second radiation elements are capacitively coupled to each other, and an LC resonator is formed of the meander portion, and the portion where the first and second radiation elements are capacitively coupled to each other.

The antenna apparatus according to the present disclosure can operate in multiple bands, while having a small size.

DETAILED DESCRIPTION

Figure 1:
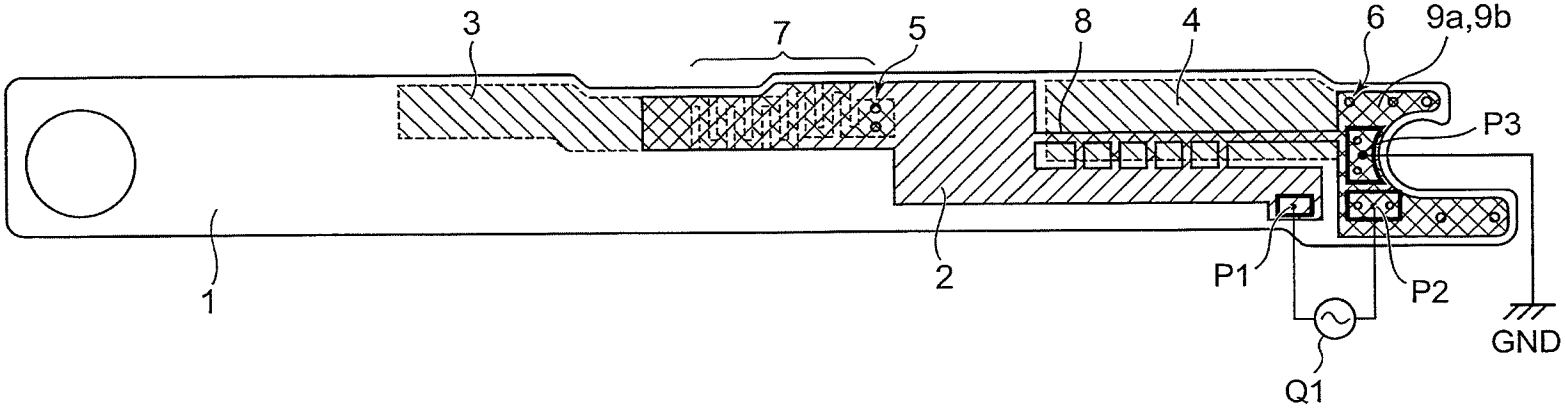
FIG. 1 is a top view showing a configuration of an antenna apparatus 10 according to a first embodiment.

Embodiments will be described in detail below, appropriately referring to the drawings. Note that an unnecessarily detailed description may be omitted. For example, detailed descriptions of well-known matters or an redundant descriptions of substantially the same configurations may be omitted. This is to avoid the following description from being unnecessarily redundant, and to facilitate ease of understanding by those skilled in the art.

Note that the inventors provide the following description and the accompanying drawings, not to limit the claimed subject matters, but to facilitate for those skilled in the art to sufficiently understand the present disclosure.

First Embodiment

Figure 2:
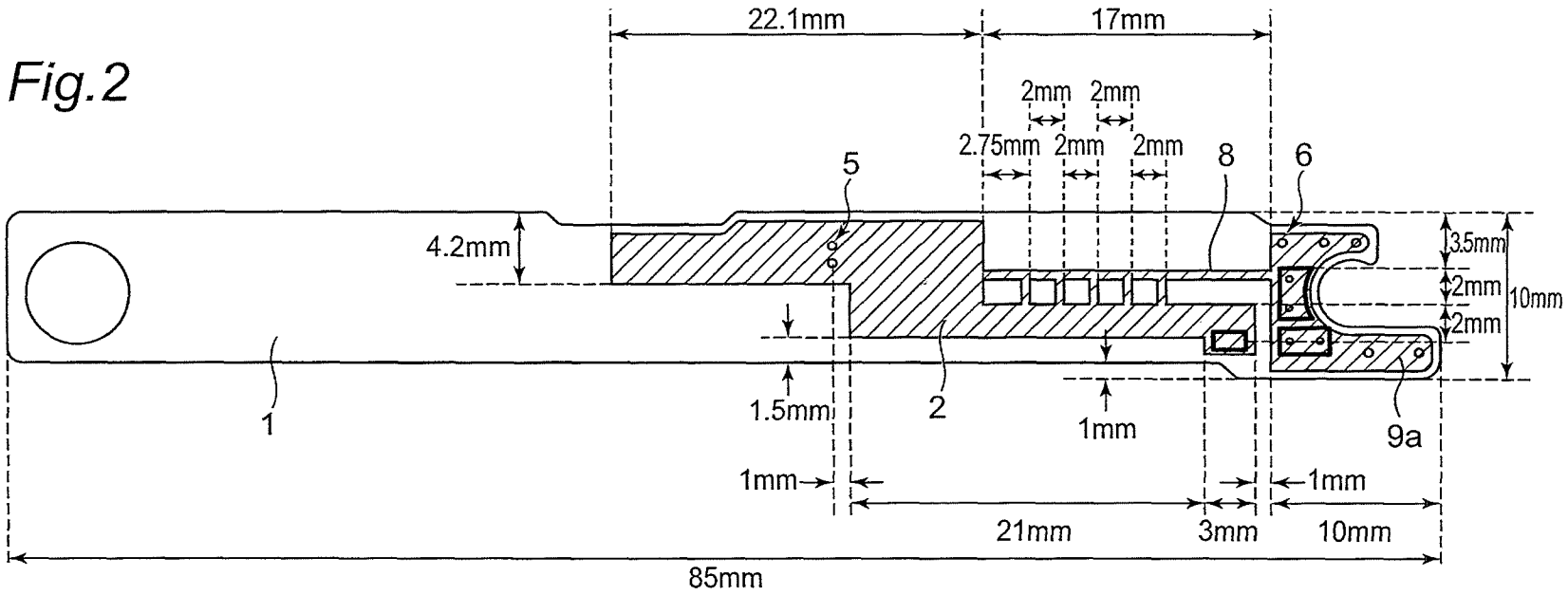
FIG. 2 is a top view showing conductive patterns on a first surface of the antenna apparatus 10 of FIG. 1.
Figure 3:
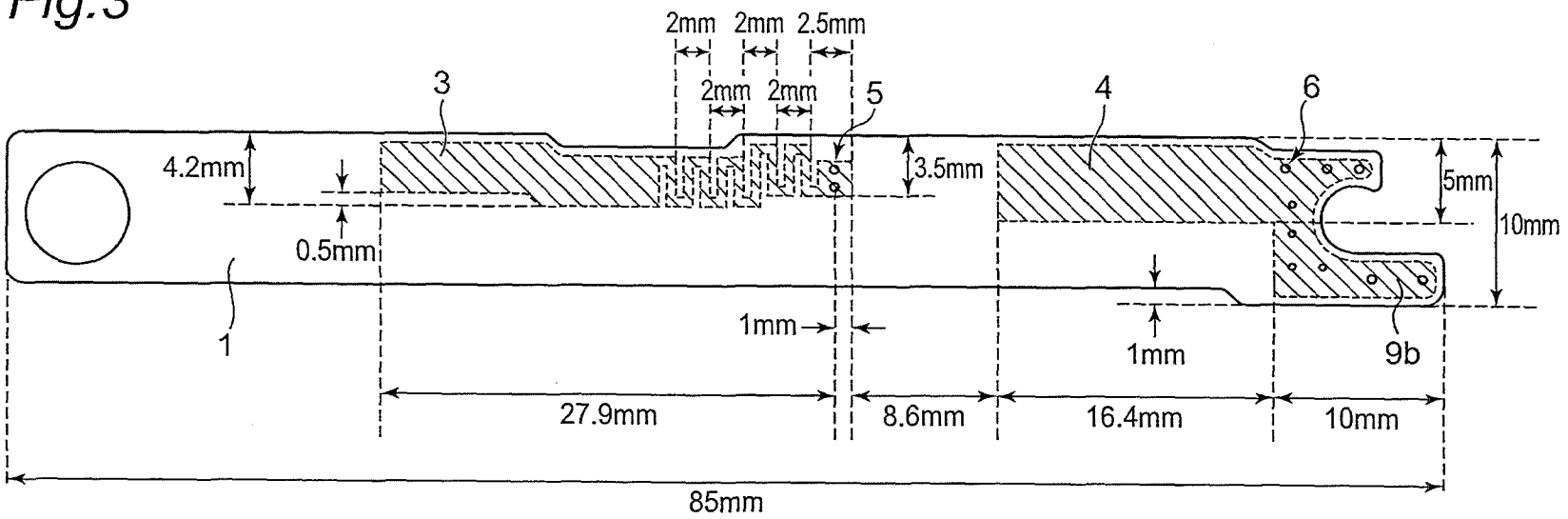
FIG. 3 is a top view showing conductive patterns on a second surface of the antenna apparatus 10 of FIG. 1.

FIG. 1 is a top view showing a configuration of an antenna apparatus 10 according to a first embodiment. FIG. 2 is a top view showing conductive patterns on a first surface of the antenna apparatus 10 of FIG. 1. FIG. 3 is a top view showing conductive patterns on a second surface of the antenna apparatus 10 of FIG. 1.

The antenna apparatus 10 is provided with: a dielectric substrate 1 having a certain width and a certain length, and having a first end (hereinafter, referred to as a "right end" according to the drawings) and a second end (hereinafter, referred to as a "left end" according to the drawings) along its longitudinal direction, and having the first surface (front surface) and the second surface (back surface); a radiation element 2, a connection conductor 8, and a ground conductor 9*a*, each being formed on the first surface of the dielectric substrate 1; and radiation elements 3 and 4 and a ground conductor 9*b*, each being formed on the second surface of the dielectric substrate 1. In an example as shown in FIGS. 1 and 3, the radiation elements 3 and 4 and the ground conductor 9*b* formed on the second surface of the dielectric substrate 1 are shown by dashed lines. The radiation elements 2 to 4, the connection conductor 8, and the ground conductors 9*a* and 9*b* are formed, for example, as conductive patterns on both surfaces of a printed circuit board.

The ground conductors 9*a* and 9*b* are provided at certain positions on the dielectric substrate 1, for example, positions close to the right end of the dielectric substrate 1. The radiation element 2 is formed on the first surface, and extends over a first length, from a position at a certain distance from the ground conductor 9*a* (in the example as shown in FIG. 1, a position on the left side of the ground conductor 9*a*), toward the left end of the dielectric substrate 1. The antenna apparatus 10 is provided with a feed point P1 on the radiation, element 2, and another feed point P2 on the ground conductor 9*a*, at positions where the radiation element 2 and the ground conductor 9*a* are close to each other. Therefore, the radiation element 2 extends from the feed point P1 toward the left end of the dielectric substrate 1, and has a first end close to the feed point P1 (hereinafter, referred to as a "right end" according to the drawings), and a second end remote from the feed point P1 (hereinafter, referred to as a "left end" according to the drawings). The radiation element 3 is formed on the back surface of the dielectric substrate 1, and extends over a second length along the longitudinal direction of the dielectric substrate 1. The radiation element 3 has a first end (hereinafter, referred to as a "right end" according to the drawings), and a second end (hereinafter, referred to as a "left end" according to the drawings), and the second end is remoter from the feed point P1 than the first end. Accordingly, a first end is relatively close to the feed point P1, and a second end is relatively remote from the feed point P1. The radiation element 3 includes a portion overlapping with the radiation element 2 via the dielectric substrate 1, and a portion extending from a position overlapping with the left end of the radiation element 2 towards the left end of the dielectric substrate 1. The antenna apparatus 10 is provided with at least one through-hole conductor 5 at a position(s) in the portion where the radiation conductors 2 and 3 overlaps with each other via the dielectric substrate 1, and the through-hole conductor 5 penetrates through the dielectric substrate 1, and electrically connects the radiation elements 1 and 2. According to the example of FIGS. 1 to 3, the through-hole conductor 5 is provided at the right end of the radiation conductor 3. Further, the antenna apparatus 10 is provided with at least one through-hole conductor 6, and the through-hole conductor 6 penetrates through the dielectric substrate 1, and electrically connects the ground conductors 9*a* and 9*b*.

The radiation element 4 is formed on the second surface, and extends over a third length from the ground conductor 9*b* toward the left end of the dielectric substrate 1. The third length of the radiation element 4 is shorter than the first length of the radiation element 2. The radiation element 4 and the ground conductor 9*b* are formed integrally. Therefore, since the radiation element 4 is electrically connected to the feed point P2, the radiation element 4 can be regarded to extends from the feed point P2 toward the left end of the dielectric substrate 1. At least a part of the radiation element 4 is remote from the other radiation elements 2 and 3, so as to avoid reduced resonance of the radiation elements 4 due to strong electromagnetic coupling of the radiation elements 4 to the radiation elements 2 and 3. Therefore, for example, on both surfaces of the dielectric conductor 1, at least a part of the radiation conductor 4 is provided not to overlap with the radiation conductor 2 via the dielectric substrate 1. Further, on back surface of the dielectric conductor 1, the radiation conductor 4 is separated from the radiation conductor 3 by a certain distance.

The feed points P1 and P2 are connected to a signal source Q1, which is a wireless communication circuit or the like. The antenna apparatus 10 is provided with a ground point P3 on the ground conductor 9*a*, and grounded externally through the ground point P3. The radiation element 2 and the ground conductor 9*a* are connected to each other through the connection conductor 8 at a position different from the positions of the feed points P1 and P2. Since the radiation element 2 and the ground conductor 9*a* are connected to each other through the connection conductor 8, the antenna apparatus 10 operates as an inverted-F antenna.

The radiation element 2 is capacitively coupled to the radiation element 3 in the portion where the radiation conductors 2 and 3 overlaps with each other via the dielectric substrate 1. It is possible to adjust the capacitance between the radiation elements 2 and 3 by adjusting the position of the left end of the radiation element 2. At least one of the radiation elements 2 and 3 has a meander portion formed over a certain length, in the portion where the radiation elements 2 and 3 are capacitively coupled to each other. In the example as shown in FIG. 1, the radiation element 3 has a meander portion formed over the certain length from the right end of the radiation element 3 toward the left end of the radiation element 3. The meander portion has a certain inductance. In the example shown in FIGS. 1 and 3, the meander portion is formed of a sinuous conductive pattern with a width of 0.5 mm. It is possible to adjust the inductance of the meander portion by adjusting the length of the meander portion. Thus, an LC resonator 7 is formed of the meander portion of the radiation element 3, and the portion where the radiation elements 2 and 3 are capacitively coupled to each other. The resonance frequency of the LC resonator 7 depends on the inductance of the meander portion, and the area of a portion of the radiation element 2 overlapping with the meander portion. Therefore, the resonance frequency of the LC resonator 7 can be fixed at a required frequency, only by adjusting the position of the left end of the radiation element 2. That is, the resonance frequency of the LC resonator 7 can be adjusted, independent of the entire length of the radiation element 3 and the entire length of the radiation element 4.

The length of the meander portion may be longer or shorter than that of the example shown in FIGS. 1 to 3. For example, the meander portion may be formed over a certain length from the right end of the radiation element 3 toward the left end of the radiation element 3, beyond the left end of the radiation element 2. The structure of the meander portion can be formed according to a desired resonance frequency of the LC resonator 7.

The radiation elements 2, 3, and 4 are formed such that they are remote from each other in a width direction of the dielectric substrate 1, so as to minimize electromagnetic coupling among them (except for the portion of the LC resonator 7).

As will be described below, the antenna apparatus 10 operates at three frequencies (i.e., a low-band frequency, a mid-band frequency, and a high-band frequency).

Figure 4:
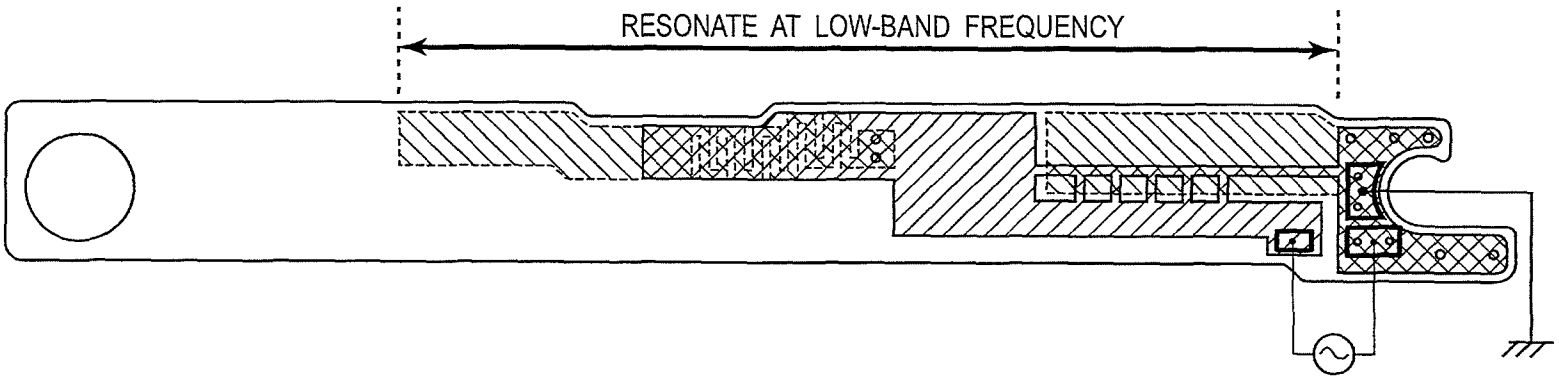
FIG. 4 is a diagram showing resonating portions of the antenna apparatus 10 of FIG. 1 when the antenna apparatus 10 operates at a low-band frequency.

FIG. 4 is a diagram showing resonating portions of the antenna apparatus 10 of FIG. 1 when the antenna apparatus 10 operates at the low-band frequency. When the antenna apparatus 10 operates at the low-band frequency, portions of the radiation elements 2 and 3 from the feed points P1 and P2 to the left end of the radiation element 3 resonate. Since the radiation element 3 has the meander portion, the electrical length of the radiation element 3 increases.

Figure 5:
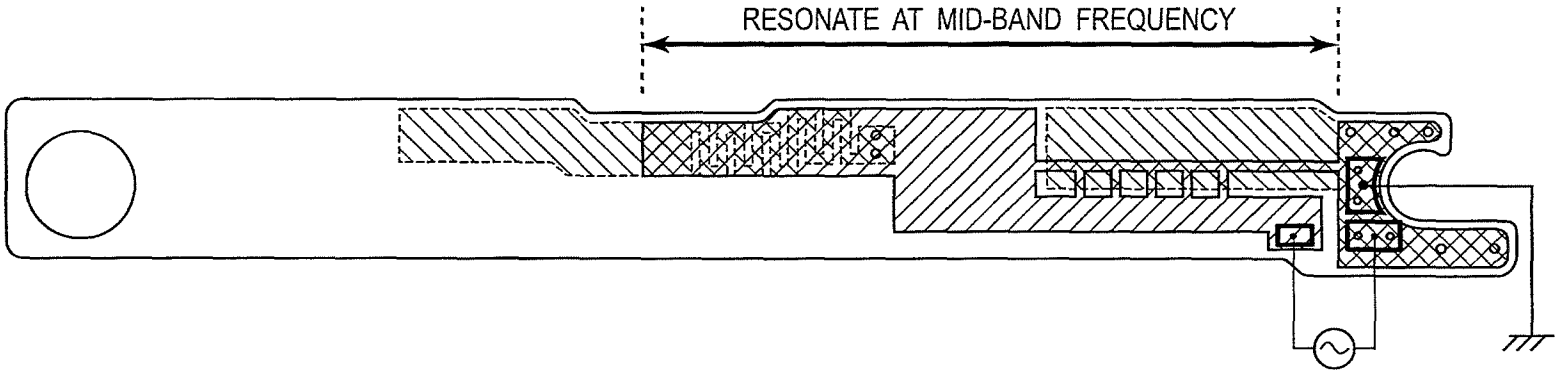
FIG. 5 is a diagram showing resonating portions of the antenna apparatus 10 of FIG. 1 when the antenna apparatus 10 operates at a mid-band frequency.

FIG. 5 is a diagram showing resonating portions of the antenna apparatus 10 of FIG. 1 when the antenna apparatus 10 operates at the mid-band frequency. When the antenna apparatus 10 operates at the mid-band frequency, a portion of the radiation element 2 from the feed points P1 and P2 to the LC resonator 7 resonates. Since the antenna apparatus 10 is provided with the LC resonator 7, the radiation element 2 resonates at the mid-band frequency, and thus, it is not necessary to provide the antenna apparatus 10 with an extra radiation element resonating only at the mid-band frequency.

Figure 6:
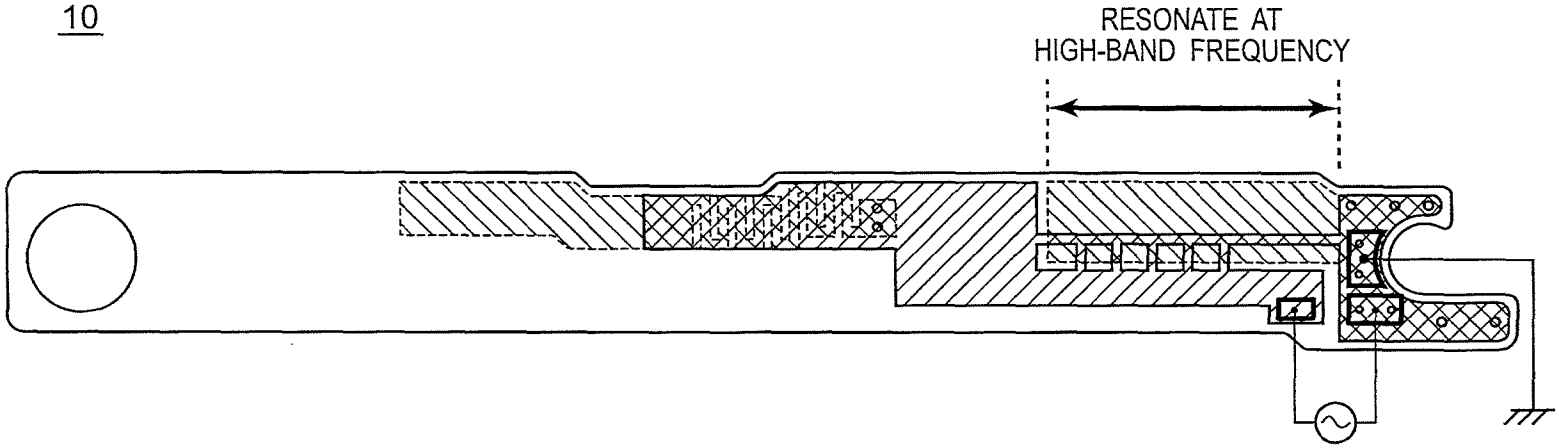
FIG. 6 is a diagram showing resonating portions of the antenna apparatus 10 of FIG. 1 when the antenna apparatus 10 operates at a high-band frequency.

FIG. 6 is a diagram showing resonating portions of the antenna apparatus 10 of FIG. 1 when the antenna apparatus 10 operates at the high-band frequency. When the antenna apparatus 10 operates at the high-band frequency, the radiation element 4 resonates.

The antenna apparatus 10 of the present disclosure operates in at least three frequency bands, including the low-band frequency band, mid-band frequency band, and high-band frequency band. The antenna apparatus 10 of the present disclosure can independently adjust the respective frequency bands in which the antenna apparatus 10 resonates. The resonance frequency in the low-band frequency band can be adjusted by changing the entire length of the radiation element 3. The resonance frequency in the mid-band frequency band can be adjusted by changing the entire length of the radiation element 2 or changing the structure of the meander portion. The resonance frequency in the high-band frequency band can be adjusted by changing the entire length of the radiation element 4. Even if the entire length of the radiation element 3 is changed by adjusting the position of the left end of the radiation element 3, there is no influence on the entire length of the radiation element 2, the meander portion, and the entire length of the radiation element 4. Even if the position of the left end of the radiation element 2 or the structure of the meander portion is changed, there is no influence on the entire length of the radiation element 3 and the entire length of the radiation element 4. Even if the entire length of the radiation element 4 is changed by adjusting the position of the left end of the radiation element 4, there is no influence on the entire length of the radiation element 3, the position of the left end of the radiation element 2, and the structure of the meander portion. In particular, with respect to the mid-band frequency band, since the LC resonator 7 is formed by the meander portion and the radiation element 2, the entire length of the antenna apparatus 10 can be reduced.

According to prior art, in order to obtain a sufficient electrical length of radiation elements of an antenna apparatus operating at a low-band frequency, there may be a need to arrange conductive patterns of the radiation elements on a dielectric substrate as shown in FIG. 1, the conductive patterns including, for example, a portion extending close to an upper edge of the dielectric substrate, a portion folded from the upper edge toward a lower edge, and a portion extending close to the lower edge. In this case, the radiation conductors extend close to both the upper and lower edges of the dielectric substrate. Therefore, in the case of providing the antenna apparatus within a housing of a wireless communication apparatus, since a portion of the radiation conductor close to the upper or lower edge of the dielectric substrate is electromagnetically coupled to metal parts and/or the housing of the wireless communication apparatus, thus degrading radiation efficiency. On the other hand, according to the antenna apparatus 10 of FIG. 1, since the radiation element 3 is close to only the upper edge of the dielectric substrate 1, it is possible to reduce electromagnetic coupling between the radiation element 3 and metal parts below the dielectric substrate 1 and/or the housing. Therefore, the antenna apparatus 10 can achieve high radiation efficiency, while operating at the low-band frequency.

In addition, according to prior art, in order for an antenna apparatus to operate at the mid-band frequency, there may be a need to provide the antenna apparatus with an extra radiation element, or reduce the electrical length of a radiation element for the operation of the antenna apparatus at the low-band frequency. In the latter case, the bandwidth in which the antenna apparatus resonates when the antenna apparatus operates at the low-band frequency becomes narrow. On the other hand, the antenna apparatus 10 of FIG. 1 can achieve a wide bandwidth, while operating at both the low-band frequency and the mid-band frequency.

Further, as a result of a combination of the inverted-F antenna and the LC resonator 7, the antenna apparatus 10 can operate at three frequencies, while having a small size. The antenna apparatus 10 can more effectively utilize a space of the same volume, compared to the prior art antenna apparatuses.

Figure 16:
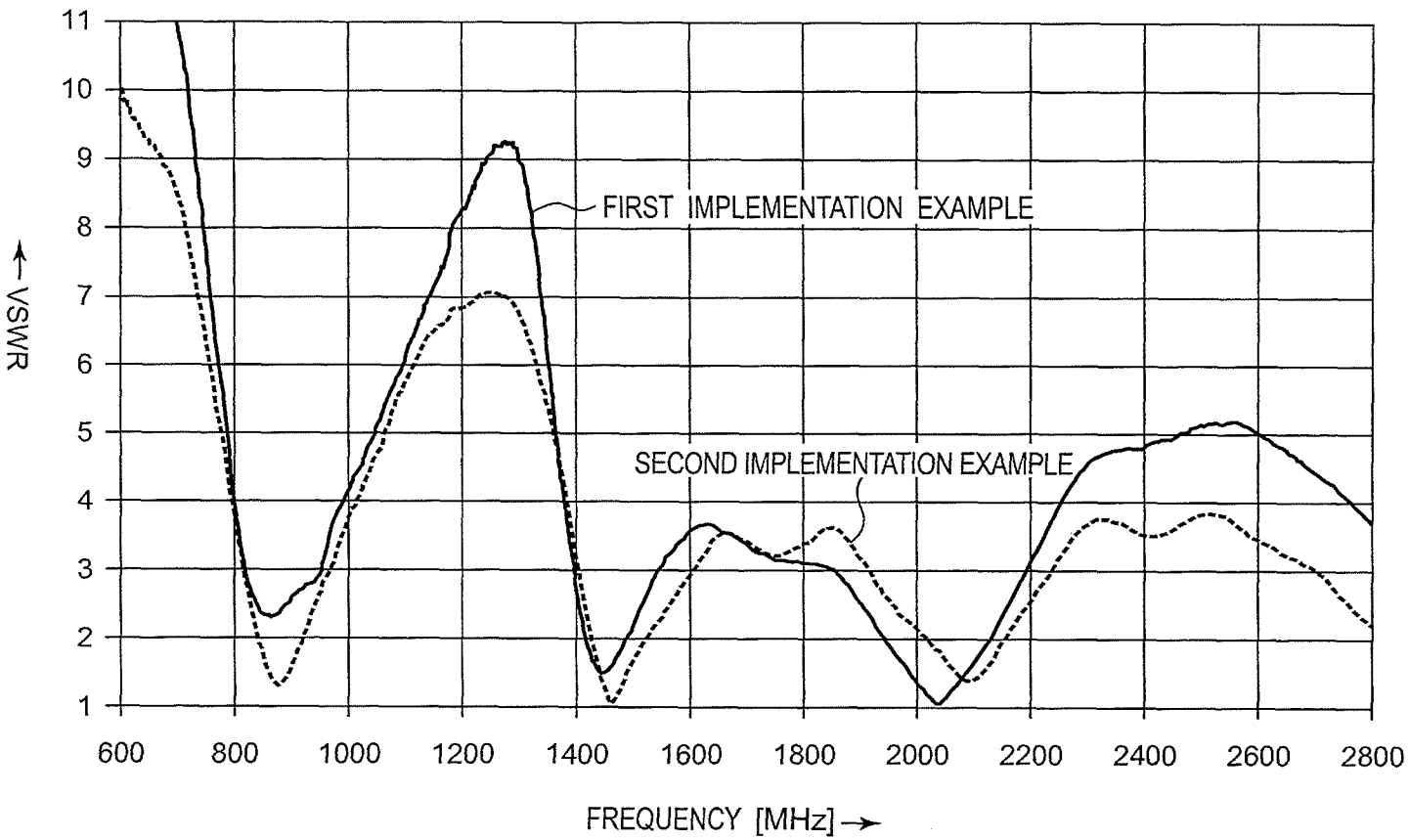
FIG. 16 is a graph showing the VSWR versus frequency characteristics of the antenna apparatus 10 of FIG. 1.

FIG. 16 is a graph showing the VSWR versus frequency characteristics of the antenna apparatus 10 of FIG. 1. The antenna apparatus 10 has dimensions shown in FIGS. 2 and 3. The dielectric substrate 1 is made of FR-4, and has a thickness of 0.8 mm. The radiation elements 2 to 4 are conductors formed on the dielectric substrate 1. Each of the through-hole conductors 5 and 6 has a diameter of 0.4 mm. FIG. 16 shows the results of two measurements performed on the antenna apparatus 10 with such a configuration. According to FIG. 16, it can be seen that the antenna apparatus 10 surely operates at three frequencies. The antenna apparatus 10 can use, for example, a frequency of 2G or 3G mobile phones, as the low-band frequency. The antenna apparatus 10 can use, for example, a 1.5 GHz band frequency for LTE (Long Term Evolution), as the mid-band frequency. The antenna apparatus 10 can use, for example, a 2.1 GHz band frequency for LTE, as the high-band frequency. The antenna apparatus 10 can be applied not only to those wireless communication services, but also to any other wireless LAN, wireless WAN, etc.

The shape of the dielectric substrate 1 is not limited to the one shown in FIG. 1, and the dielectric substrate 1 may be shaped in any other shape, including other polygons or a shape including curves.

The radiation element 4 is not limited to extending from the feed point P2 toward the left end of the dielectric substrate 1, and may extend in any other direction from the feed point P2. In this case, as described above, at least a part of the radiation element 4 is remote from the other radiation elements 2 and 3, so as to avoid reduced resonance of the radiation elements 4 due to strong electromagnetic coupling of the radiation elements 4 to the radiation elements 2 and 3.

In addition, the radiation element 4 may be removed from the antenna apparatus 10 of FIG. 1, and the antenna apparatus 10 may operate only at the low-band frequency and the mid-band frequency. In this case, the antenna apparatus 10 can operate at two frequencies, while having a small size.

Figure 7:
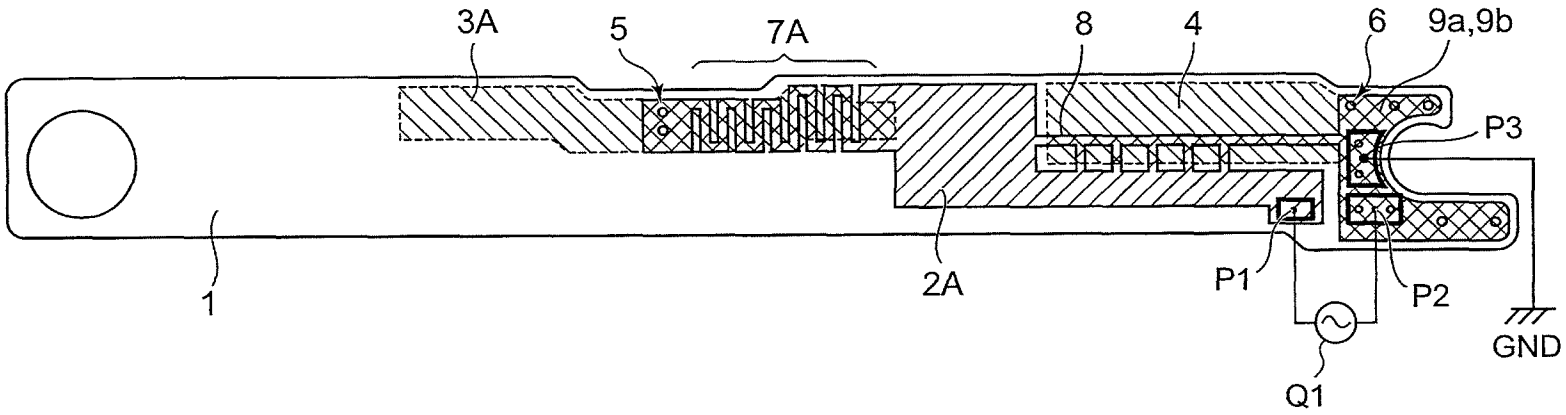
FIG. 7 is a top view showing a configuration of an antenna apparatus 11 according to a modified embodiment of the first embodiment.
Figure 8:
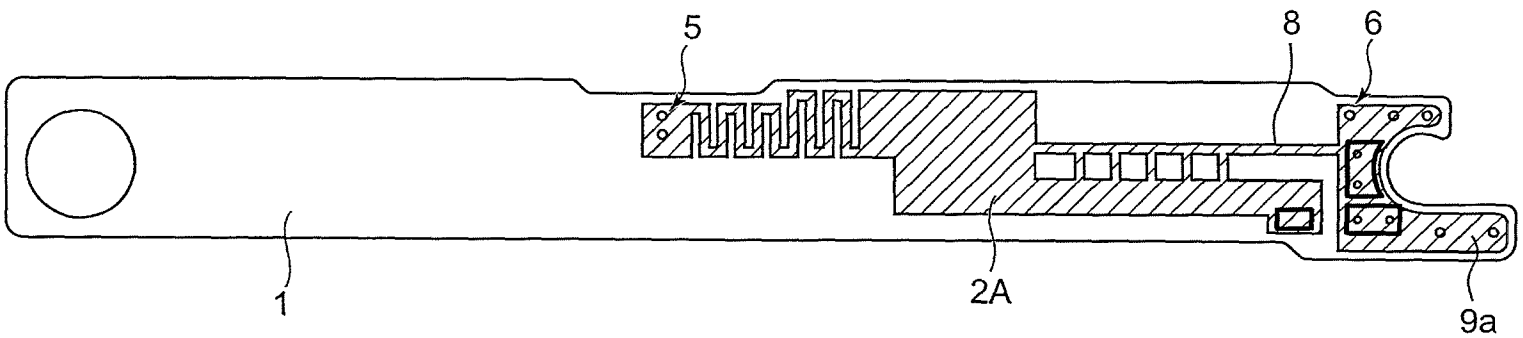
FIG. 8 is a top view showing conductive patterns on a first surface of the antenna apparatus 11 of FIG. 7.
Figure 9:
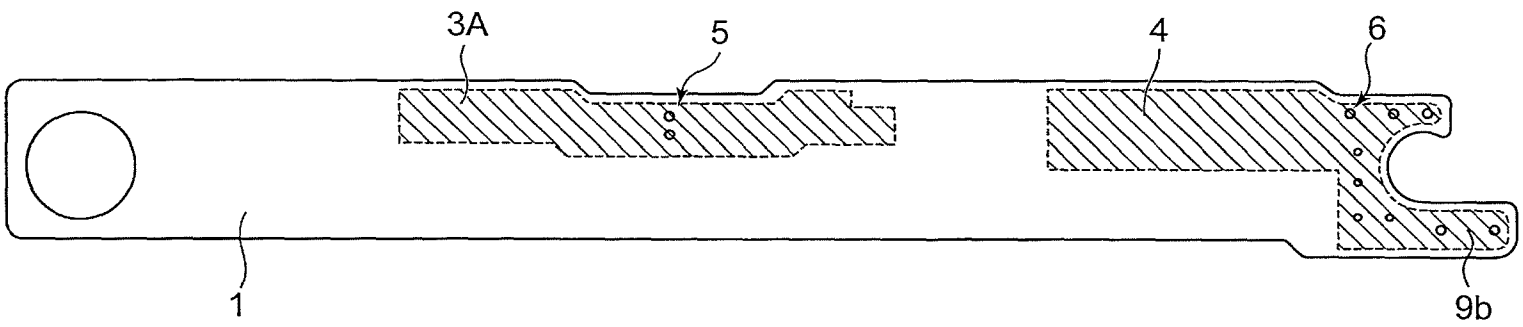
FIG. 9 is a top view showing conductive patterns on a second surface of the antenna apparatus 11 of FIG. 7.

FIG. 7 is a top view showing a configuration of an antenna apparatus 11 according to a modified embodiment of the first embodiment. FIG. 8 is a top view showing conductive patterns on a first surface of the antenna apparatus 11 of FIG. 7. FIG. 9 is a top view showing conductive patterns on a second surface of the antenna apparatus 11 of FIG. 7. The meander portion is not limited to being formed in the radiation element 3 on the second surface of the dielectric substrate 1 of FIG. 1, and may be formed in the radiation element 2 on the first surface. The antenna apparatus 11 of FIG. 7 is provided with: a radiation element 2A with a meander portion; and a radiation element 3A without a meander portion. An LC resonator 7A is formed of the meander portion of the radiation element 2A, and a portion where the radiation elements 2A and 3A are capacitively coupled to each other. According to the example of FIGS. 7 to 9, the through-hole conductor 5 is provided at the left end of the radiation conductor 2A.

In addition, meander portions may be formed in both the radiation element 2 on the first surface and the radiation element 3 on the second surface of the dielectric substrate 1 of FIG. 1.

Second Embodiment

In the first embodiment, an antenna apparatus configured as an inverted-F antenna is described as an example of the antenna apparatus of the present disclosure. However, note that the antenna apparatus of the present disclosure can be applied to the configurations of other antenna apparatuses than the inverted-F antenna. For example, the antenna apparatus of the present disclosure can also be applied to the configuration of a monopole antenna.

Figure 10:
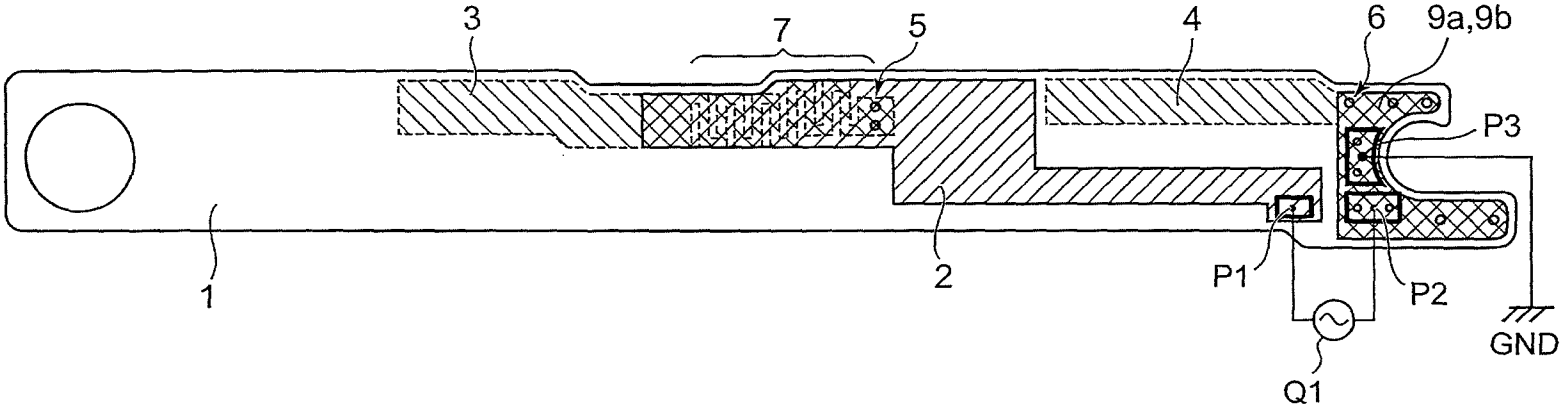
FIG. 10 is a top view showing a configuration of an antenna apparatus 12 according to a second embodiment.
Figure 11:
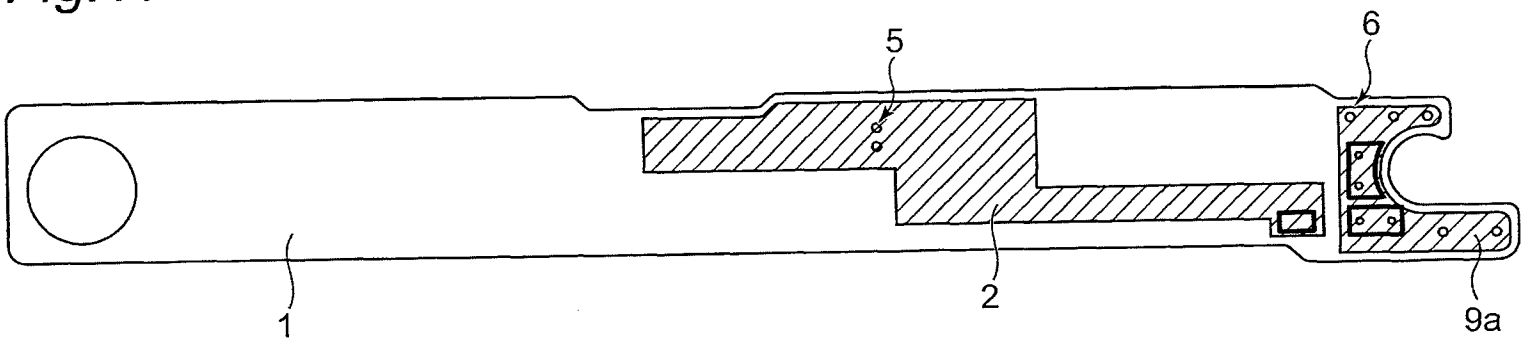
FIG. 11 is a top view showing conductive patterns on a first surface of the antenna apparatus 12 of FIG. 10.
Figure 12:
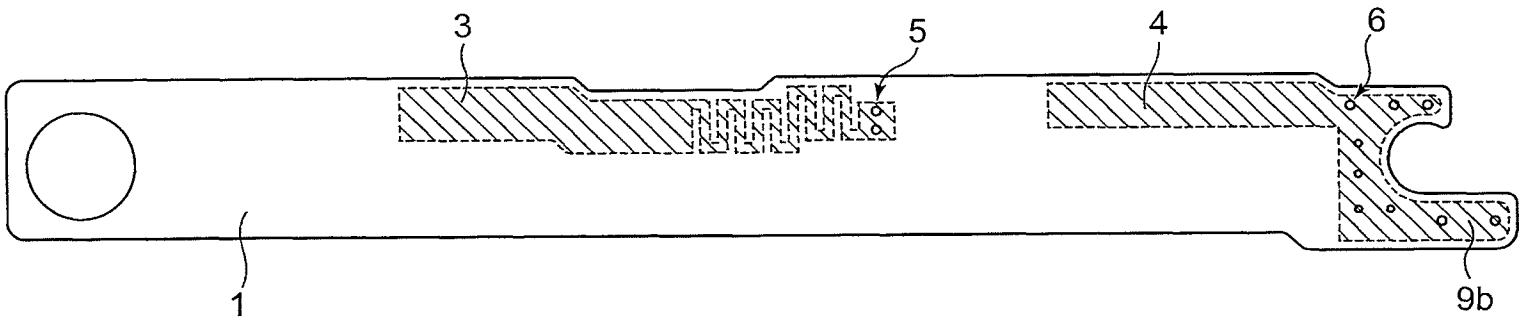
FIG. 12 is a top view showing conductive patterns on a second surface of the antenna apparatus 12 of FIG. 10.

With reference to FIGS. 10 to 12, a modified embodiment will be specifically described in which the antenna apparatus of the present disclosure is configured as a monopole antenna.

FIG. 10 is a top view showing a configuration of an antenna apparatus 12 according to a second embodiment. FIG. 11 is a top view showing conductive patterns on a first surface of the antenna apparatus 12 of FIG. 10. FIG. 12 is a top view showing conductive patterns on a second surface of the antenna apparatus 12 of FIG. 10. The conductive patterns on the first surface are substantially the same as the conductive patterns shown in FIG. 2, except that a connection conductor 8 is removed. A radiation element 2 is not electrically connected to a ground point P3. The conductive patterns on the second surface are substantially the same as the conductive patterns shown in FIG. 3.

Even when the basic configuration of the antenna apparatus of the present disclosure is applied to a monopole antenna, it is possible to provide a small antenna apparatus operable in multiple bands.

Figure 13:
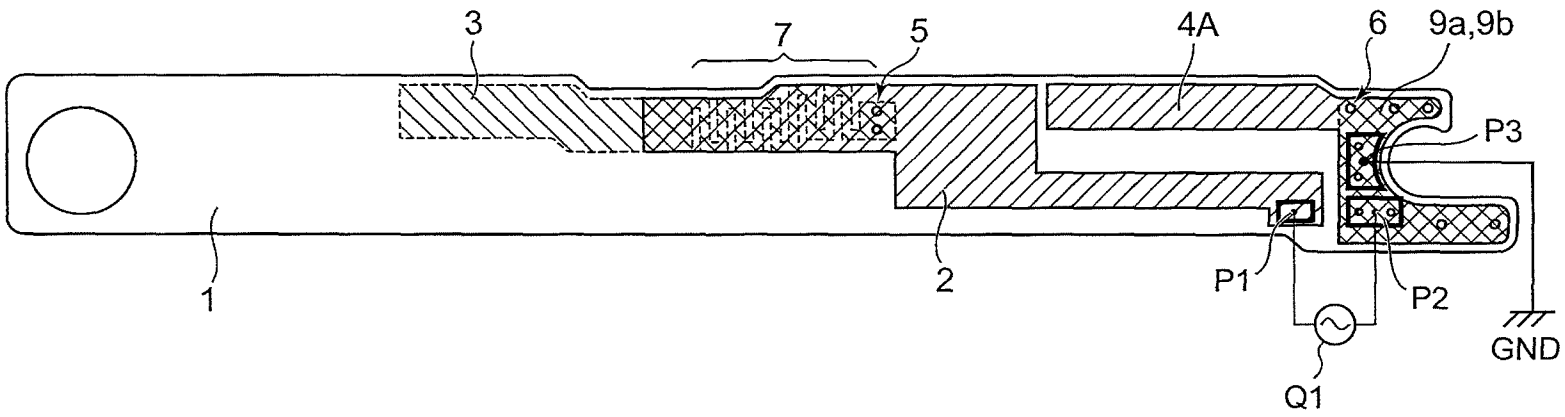
FIG. 13 is a top view showing a configuration of an antenna apparatus 13 according to a modified embodiment of the second embodiment.
Figure 14:
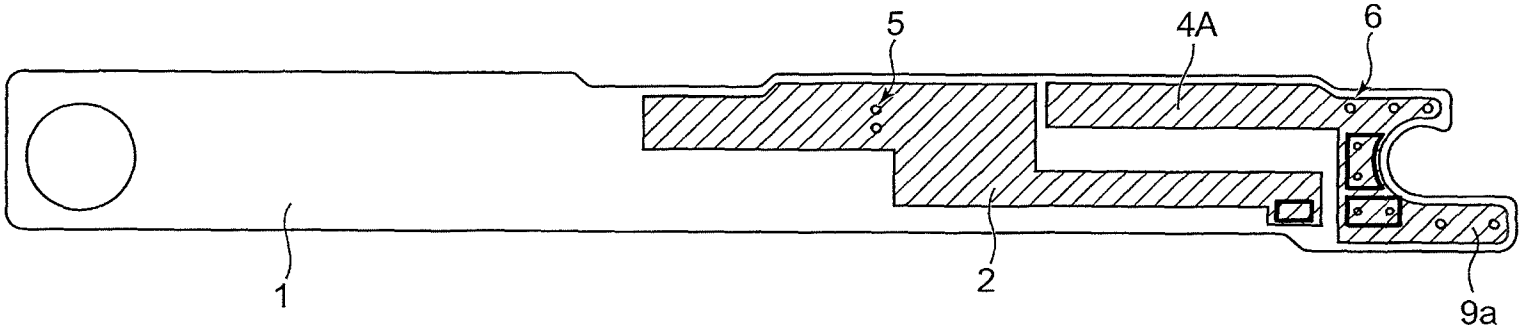
FIG. 14 is a top view showing conductive patterns on a first surface of the antenna apparatus 13 of FIG. 13.
Figure 15:
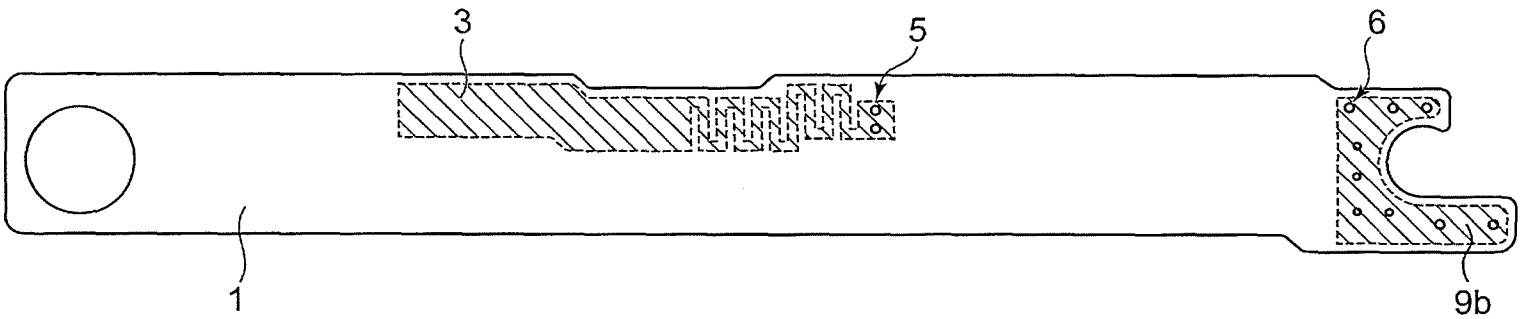
FIG. 15 is a top view showing conductive patterns on a second surface of the antenna apparatus 13 of FIG. 13.

FIG. 13 is a top view showing a configuration of an antenna apparatus 13 according to a modified embodiment of the second embodiment. FIG. 14 is a top view showing conductive patterns on a first surface of the antenna apparatus 13 of FIG. 13. FIG. 15 is a top view showing conductive patterns on a second surface of the antenna apparatus 13 of FIG. 13. A radiation element 4 shown in FIG. 1 or 10 is not limited to being formed on a second surface of a dielectric substrate 1, and may be formed on a first surface. The antenna apparatus 13 of FIG. 13 is provided with a radiation element 4A formed on a first surface of a dielectric substrate 1. At least a part of the radiation element 4A is remote from the other radiation elements 2 and 3, so as to avoid reduced resonance of the radiation elements 4A due to strong electromagnetic coupling of the radiation elements 4A to the radiation elements 2 and 3. In addition, also in the antenna apparatuses 10 and 11 shown in FIGS. 1 and 7, the radiation element 4 may be formed on the first surface of the dielectric substrate 1.

Third Embodiment

Figure 17:
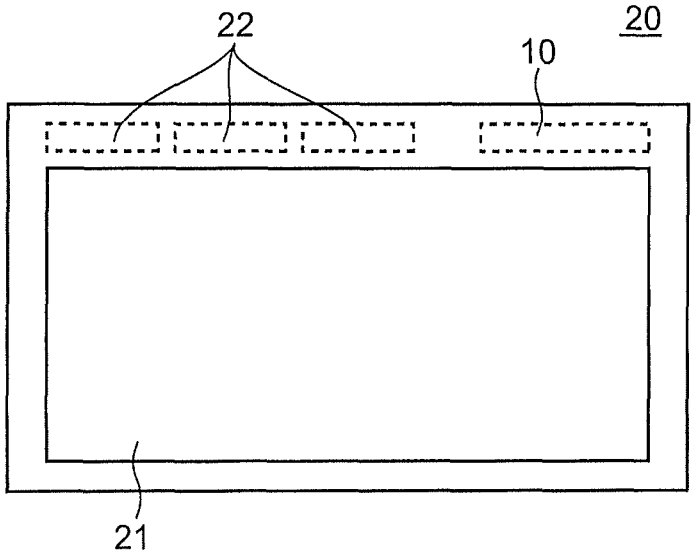
FIG. 17 is a schematic diagram showing a wireless communication apparatus 20 according to a third embodiment.

FIG. 17 is a schematic diagram showing a wireless communication apparatus 20 according to a third embodiment. The wireless communication apparatus 20 is provided with: an antenna apparatus 10 of FIG. 1, a liquid crystal display 21, and other circuits such as a wireless communication circuit 22. The liquid crystal display 21 includes therein metal parts such as ground conductors. Though the antenna apparatus 10 is close to the liquid crystal display 21, the antenna apparatus 10 can operate without reducing its radiation efficiency. The antenna apparatus 10 of FIG. 1 can be applied not only to liquid crystal displays, but also to any other wireless communication apparatus 20 and electronic device (e.g., personal computers, mobile phones, etc.).

Figure 18:
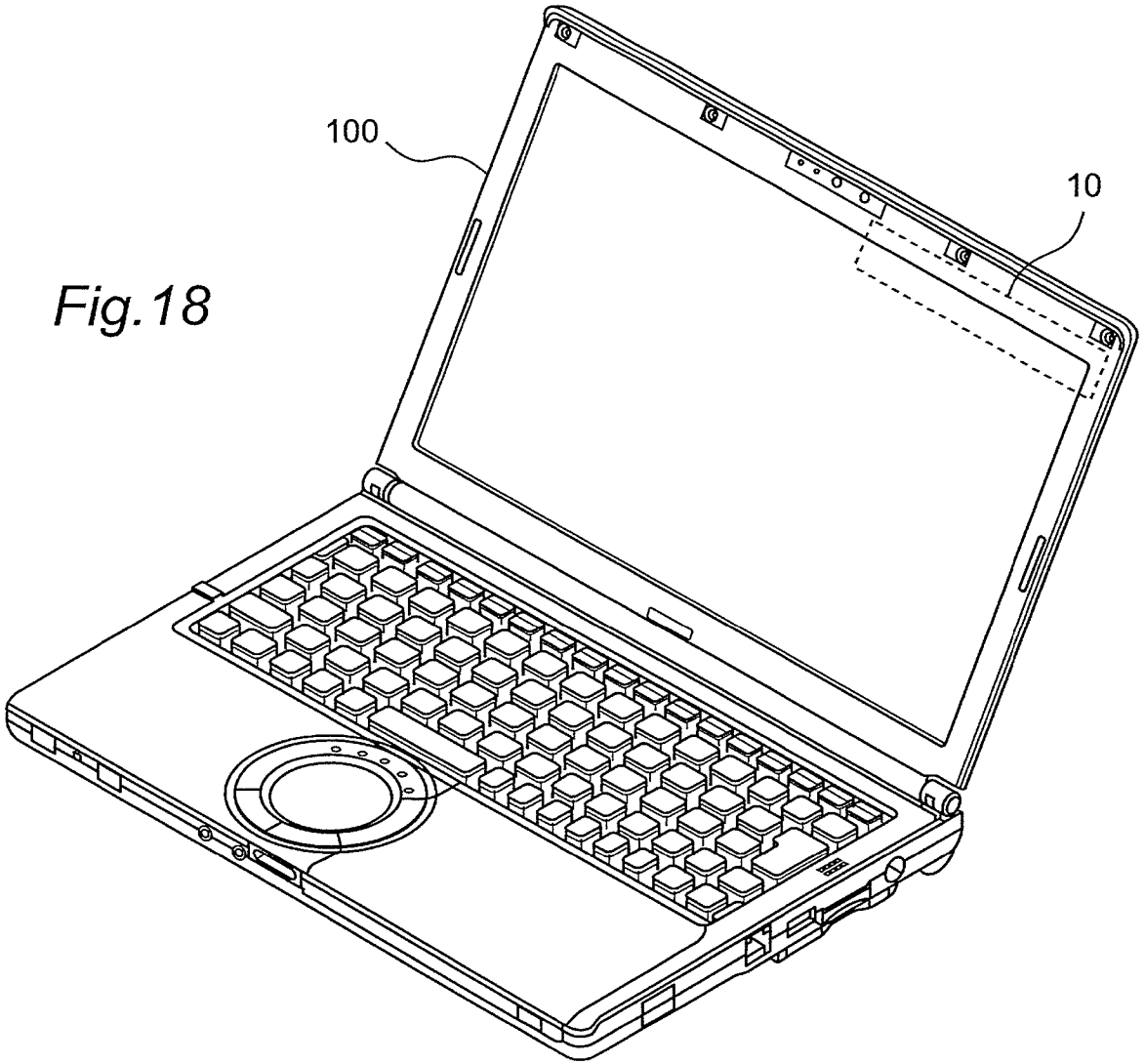
FIG. 18 is an opened perspective view showing a personal computer 100 according to a modified embodiment of the third embodiment.
Figure 19:
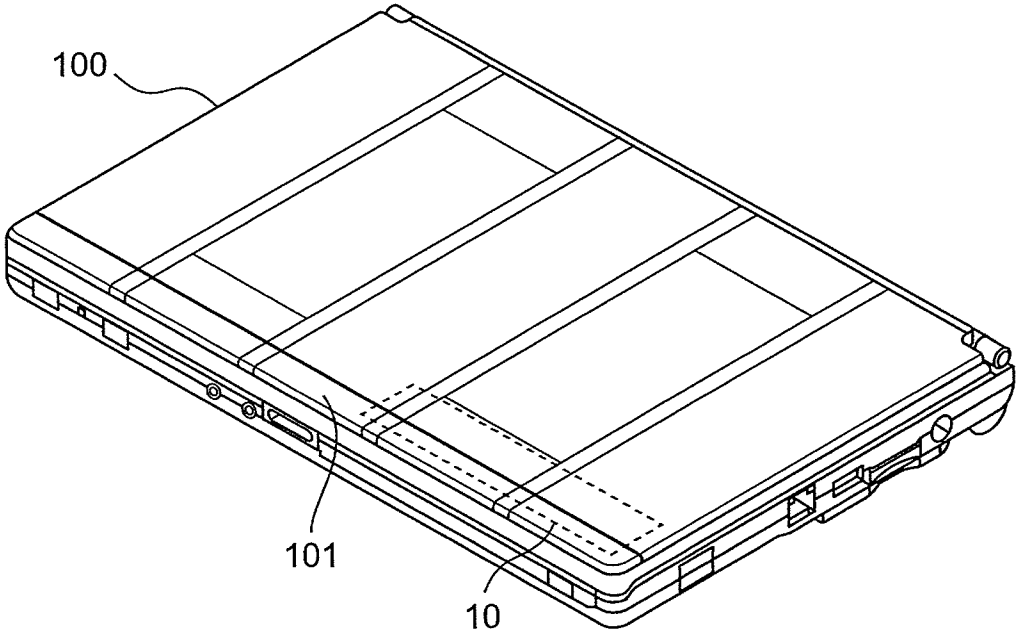
FIG. 19 is a closed perspective view showing the personal computer 100 of FIG. 18.

FIG. 18 is an opened perspective view showing a personal computer 100 according to a modified embodiment of the third embodiment. FIG. 19 is a closed perspective view showing the personal computer 100 of FIG. 18. The personal computer 100 of FIG. 18 is provided with an antenna apparatus 10 of FIG. 1. As shown in FIG. 19, a portion close to the antenna apparatus 10 is made of a resin housing portion 101, instead of a metal housing.

As described above, the embodiments are described as examples of the technique disclosed in the present application. However, the technique according to the present disclosure is not limited thereto, and can also be applied to other embodiments including appropriate changes, substitutions, additions, omissions, etc.

As described above, the embodiments are described as examples of the technique according to the present disclosure. To this end, the detailed description and accompanying drawings are provided.

Therefore, the components described in the detailed description and accompanying drawings may include not only those components necessary to solve the problems, but also those components to exemplify the technique and not necessary to solve the problems. Hence, the unnecessary components should not be judged to be necessary just because the unnecessary components are described in the detailed description and accompanying drawings.

In addition, since the above-described embodiments are examples of the technique according to the present disclosure, it is possible to make various changes, substitutions, additions, omissions, etc., within the scope of the claims or their equivalency.

The present disclosure can be applied to a small antenna apparatus operable in multiple bands, and it is possible to reduce effects of metal parts and/or a housing around the antenna apparatus. The present disclosure can be applied to a small multiband antenna apparatus, for example, for LTE.

The invention claimed is:

1. An antenna apparatus, comprising:

a single dielectric substrate having a first end and a second end along a longitudinal direction, and having a first surface and a second surface, the first and second surfaces being major surfaces of the single dielectric substrate;

a single feed point electrically connectable to a signal source;

a first radiation element formed on the first surface, and extending from the single feed point provided at a position of the dielectric substrate over a first length from the single feed point toward the second end of the single dielectric substrate, the first radiation element having a first end close to the single feed point and a second end remote from the single feed point;

a second radiation element formed on the second surface, and extending over a second length along the longitudinal direction of the single dielectric substrate, the second radiation element having a first end and a second end, the second end being more remote from the single feed point than the first end, and the second radiation element including a portion overlapping with the first radiation element via the single dielectric substrate, and a portion extending from a position overlapping with the second end of the first radiation element towards the second end of the single dielectric substrate such that the second end of the second radiation element is more remote from the single feed point than the second end of the first radiation element; and at least one through-hole conductor provided at a position in the portion where the first and second radiation elements overlap with each other via the single dielectric substrate, and the through-hole conductor penetrating through the single dielectric substrate, the through-hole conductor electrically connecting the first and second radiation elements, and thereby the only feed point for the second radiation element is the single feed point for the first radiation element, wherein the first radiation element is capacitively coupled to the second radiation element in the portion where the first and second radiation elements overlap with each other via the single dielectric substrate, and wherein in the portion where the first and second radiation elements are capacitively coupled to each other, one of the first and second radiation elements has a meander portion, an other of the first and second radiation elements has a non-meander portion opposed to the meander portion, the non-meander portion having a width perpendicular to the longitudinal direction of the single dielectric substrate such that the non-meander portion is opposed to an entire area of the meander portion, and an LC resonator is formed of the meander portion and the non-meander portion, the through hole conductor being disposed at the first end of the second radiation element and between the first and second ends of the first radiation element.

2. The antenna apparatus as claimed in claim 1, wherein, when the antenna apparatus operates at a first frequency, portions of the first and second radiation elements from the single feed point to the second end of the second radiation element resonate, and wherein, when the antenna apparatus operates at a second frequency higher than the first frequency, a portion of the first radiation element from the single feed point to the LC resonator resonates.

3. The antenna apparatus as claimed in claim 1, further comprising a third radiation element formed on the first or second surface, and extending over a third length in a direction from the single feed point, wherein at least a part of the third radiation element is remote from the first and second radiation elements.

4. The antenna apparatus as claimed in claim 3, wherein the third length is shorter than the first length, wherein at least a part of the third radiation element is provided not to overlap with the first radiation element via the single dielectric substrate, and wherein the third radiation element is formed on the second surface, and separated from the second radiation element by a certain distance.

5. The antenna apparatus as claimed in claim 3, wherein, when the antenna apparatus operates at a first frequency, portions of the first and second radiation elements from the single feed point to the second end of the second radiation element resonate, wherein, when the antenna apparatus operates at a second frequency higher than the first frequency, a portion of the first radiation element from the single feed point to the LC resonator resonates, and wherein, when the antenna apparatus operates at a third frequency higher than the second frequency, the third radiation element resonates.

6. The antenna apparatus as claimed in claim 1, wherein the antenna apparatus is configured as an inverted-F antenna.

7. The antenna apparatus as claimed in claim 1, wherein the antenna apparatus is configured as a monopole antenna.

8. An antenna apparatus, comprising:

a single dielectric substrate having a first end and a second end along a longitudinal direction, and having a first surface and a second surface, the first and second surfaces being major surfaces of the single dielectric substrate;

a single feed point electrically connectable to a signal source;

a first radiation element formed on the first surface, and extending from the single feed point provided at a position of the dielectric substrate over a first length from the single feed point toward the second end of the single dielectric substrate, the first radiation element having a first end close to the single feed point and a second end remote from the single feed point;

a second radiation element formed on the second surface, and extending over a second length along the longitudinal direction of the single dielectric substrate, the second radiation element having a first end and a second end, the second end being more remote from the single feed point than the first end, and the second radiation element including a portion overlapping with the first radiation element via the single dielectric substrate, and a portion extending from a position overlapping with the second end of the first radiation element towards the second end of the single dielectric substrate such that the second end of the second radiation element is more remote from the single feed point than the second end of the first radiation element; and at least one through-hole conductor provided at a position in the portion where the first and second radiation elements overlap with each other via the single dielectric substrate, and the through-hole conductor penetrating through the single dielectric substrate, the through-hole conductor electrically connecting the first and second radiation elements, and thereby the only feed point for the second radiation element is the single feed point for the first radiation element, wherein the first radiation element is capacitively coupled to the second radiation element in the portion where the first and second radiation elements overlap with each other via the single dielectric substrate, and wherein in the portion where the first and second radiation elements are capacitively coupled to each other, one of the first and second radiation elements has a meander portion, an other of the first and second radiation elements has a non-meander portion opposed to the meander portion, the non-meander portion having a width perpendicular to the longitudinal direction of the single dielectric substrate such that the non-meander portion is opposed to an entire area of the meander portion, and an LC resonator is formed of the meander portion and the non-meander portion, the through hole conductor being disposed at one of the first end of the second radiation element and between the first and second ends of the first radiation element and the first end of the first radiation element and between the first and second ends of the second radiation element, wherein the first radiation element is connectable to the signal source via the single feed point such that the first radiation element receives a signal from the signal source via the single feed point, and the second radiation element receives the signal from the signal source via the single feed point, the first radiation element, and the through-hole conductor.

9. An antenna apparatus, comprising:

a single dielectric substrate having a first end and a second end along a longitudinal direction, and having a first surface and a second surface, the first and second surfaces being major surfaces of the single dielectric substrate;

first and second feed points connectable to a signal source;

a first radiation element formed on the first surface, and extending from the first feed point provided at a position of the dielectric substrate over a first length from the first feed point toward the second end of the single dielectric substrate, the first radiation element having a first end close to the first feed point and a second end remote from the first feed point;

a second radiation element formed on the second surface, and extending over a second length along the longitudinal direction of the single dielectric substrate, the second radiation element having a first end and a second end, the second end being more remote from the first feed point than the first end, and the second radiation element including a portion overlapping with the first radiation element via the single dielectric substrate, and a portion extending from a position overlapping with the second end of the first radiation element towards the second end of the single dielectric substrate such that the second end of the second radiation element is more remote from the single feed point than the second end of the first radiation element; and at least one through-hole conductor provided at a position in the portion where the first and second radiation elements overlap with each other via the single dielectric substrate, and the through-hole conductor penetrating through the single dielectric substrate, the through-hole conductor electrically connecting the first and second radiation elements, wherein the first radiation element is capacitively coupled to the second radiation element in the portion where the first and second radiation elements overlap with each other via the single dielectric substrate, and wherein in the portion where the first and second radiation elements are capacitively coupled to each other, one of the first and second radiation elements has a meander portion, an other of the first and second radiation elements has a non-meander portion opposed to the meander portion, the non-meander portion having a width perpendicular to the longitudinal direction of the single dielectric substrate such that the non-meander portion is opposed to an entire area of the meander portion, and an LC resonator is formed of the meander portion and the non-meander portion, the through hole conductor being disposed at one of the first end of the second radiation element and between the first and second ends of the first radiation element and the first end of the first radiation element and between the first and second ends of the second radiation element, wherein the first radiation element is connectable to the signal source via the first feed point such that the first radiation element receives a signal from the signal source via the first feed point, and the second radiation element receives the signal from the signal source via the first feed point, the first radiation element, and the through-hole conductor, and the second feed point provides a ground connection for the signal source.

10. The antenna apparatus as claimed in claim 9, wherein the signal source is a wireless communication circuit.

* * * * *